United States Patent [19]

Berenbaum

[11] 4,159,698

[45] Jul. 3, 1979

[54] ANTI-POLLUTION METHOD AND APPARATUS FOR COMBUSTION ENGINES

[75] Inventor: Marvin Berenbaum, Las Vegas, Nev.

[73] Assignee: Las Vegas Research, Inc., Las Vegas, Nev.

[21] Appl. No.: 821,210

[22] Filed: Aug. 2, 1977

Related U.S. Application Data

[63] Continuation-in-part of Ser. No. 775,959, Mar. 9, 1977, abandoned.

[51] Int. Cl.[2] ..... F02M 31/00

[52] U.S. Cl. ..... 123/41.31; 123/122 R; 123/122 E; 123/139 AV

[58] Field of Search ..... 123/122 R, 122 E, 41.31, 123/139 AV; 261/36 A, 59 PC

[56] References Cited

U.S. PATENT DOCUMENTS

| | | | |
|---|---|---|---|
| 1,029,740 | 6/1912 | Beck | 123/127 |
| 1,456,025 | 5/1923 | Lee | 123/127 |
| 2,120,779 | 6/1938 | Ericson | 123/122 R |
| 3,882,692 | 5/1975 | Watanabe | 123/41.31 |

*Primary Examiner*—Ronald H. Lazarus

*Attorney, Agent, or Firm*—Wender, Murase & White

[57] ABSTRACT

Anti-pollution method and apparatus for increasing combustion efficiency in an internal combustion engine in which a fuel-air vapor is produced in an evaporation chamber, under vacuum, and is fed through a vacuum trap to the internal combustion engine downstream of the carburetor, whereby the cooled fuel-air vapor may be drawn into each combustion chamber prior to each fuel-air charge from the carburetor.

20 Claims, 5 Drawing Figures

Fig. 4
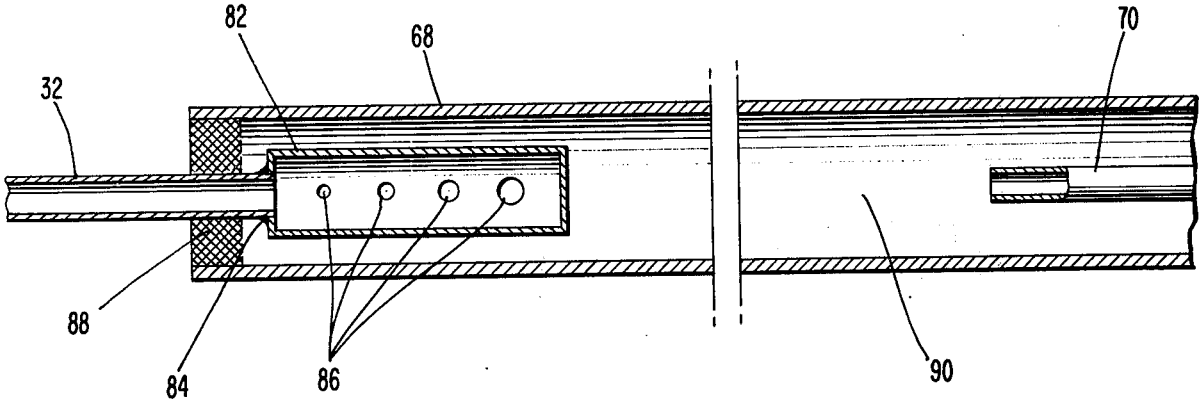
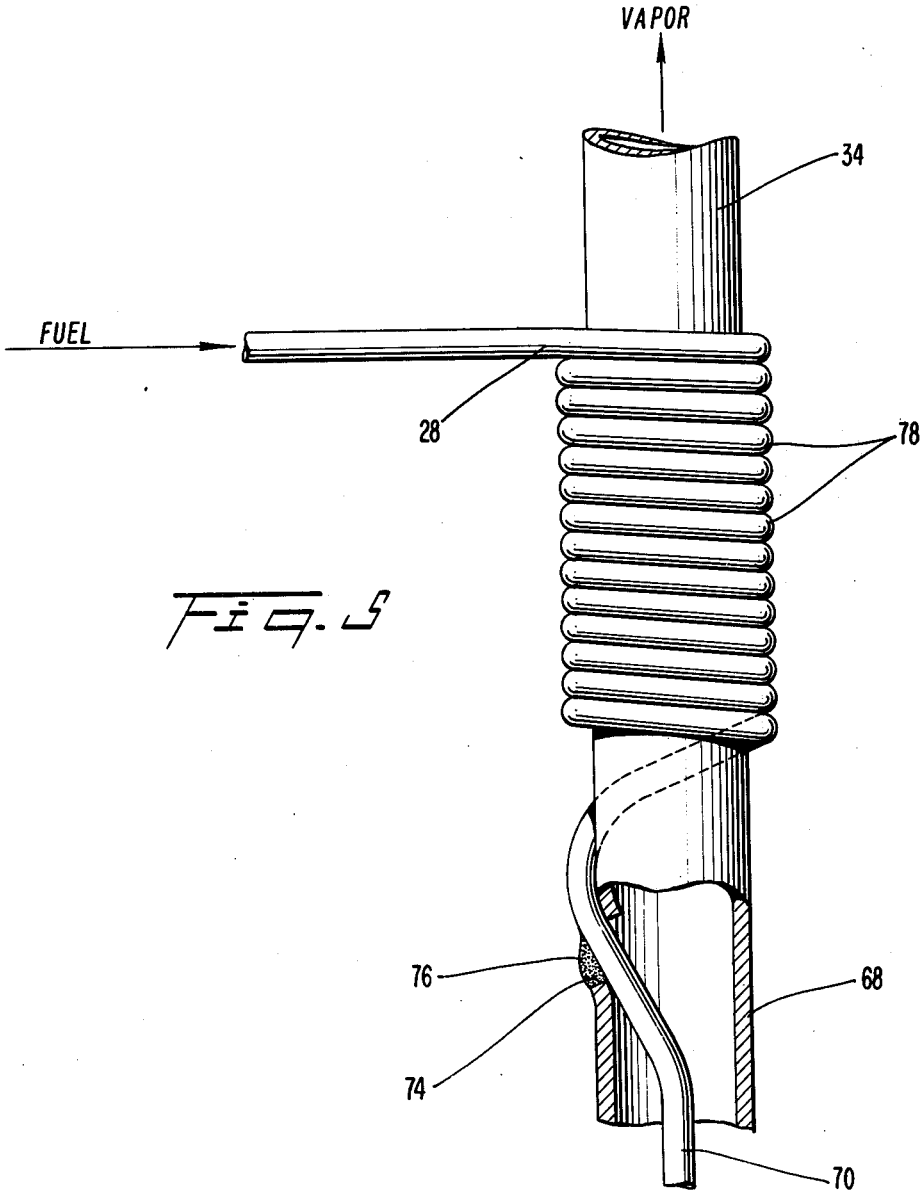
Fig. 5

ANTI-POLLUTION METHOD AND APPARATUS FOR COMBUSTION ENGINES

CROSS-REFERENCE TO RELATED APPLICATION

This is a continuation-in-part of application Ser. No. 775,959, filed Mar. 9, 1977, now abandoned.

BACKGROUND OF THE INVENTION

1. Field of the Invention

The present invention relates generally to anti-pollution apparatus and methods and, more particularly, to such apparatus and methods which may be added to an internal combustion engine fuel supply system for promoting increased combustion efficiency.

2. Description of the Prior Art

It is a well known fact that internal combustion engines do not operate at 100% efficiency. In fact, operating efficiency of conventional engines, as used in the propulsion of automobiles, trucks and other vehicles, is considerably less than 100% due primarily to heat losses and the incomplete burning of the fuel during the combustion cycle. Incomplete combustion not only reduces efficiency, but results in the generation of unburned hydrocarbons, carbon monoxide, and oxides of nitrogen in the engine exhaust. These and other constituents of internal combustion engine exhaust act either directly or by photochemical reaction with sunlight as air-pollutants. With the rapid increase in the number of automobiles, the presence of such pollutants in the environment has likewise rapidly increased with the result that several laws and regulations have been passed in an effort to reduce pollution and protect the environment.

In an effort to at least partially solve the pollution problem and, at the same time, increase engine efficiency, automotive engineers have tried several different approaches, some involving complete engine redesign and others involving the addition of supplemental systems to conventional engines. While various prior art approaches have proven to be successful in certain limited ways, a complete solution to the problem of automobile pollution and reduced efficiency heretofore has not been achieved.

An early approach to the improvement of internal combustion engine operating efficiency is shown in U.S. Pat. No. 550,776. In this patent, fuel vapors are drawn off by a partial vacuum existing within a chamber from which the vapors are fed directly to the engine carburetor. By supplying the carburetor with fuel vapor, rather than liquid fuel, it was believed that the operating efficiency of the system would be enhanced. Much later, a similar system was disclosed in U.S. Pat. No. 2,298,214 in which fuel, maintained liquid under pressure, is evaporated and cooled in a cooling coil disposed about the combustion cylinder. The cooling coil maintains the cylinder temperature within an acceptable range, and the evaporated fuel is then fed directly to the engine carburetor.

The above patents were based, at least in part, upon the theory that engine operating efficiency would be increased by the development of a fuel vapor for feeding the system carburetor. It has recently been postulated that further efficiency increases could be achieved by heating the fuel vapor before it is fed to the engine. Systems including heat evaporating vapor generators are exemplified by the structures shown in U.S. Pat. No. 3,854,463 and No. 4,003,356.

While the devices shown in the above patents and in other improved systems have caused engine efficiency to exceed levels accepted in the past, incomplete combustion, and resulting exhaust pollution, continues to be a serious problem.

SUMMARY OF THE INVENTION

It is, therefore, an object of the present invention to improve the operating efficiency of an internal combustion engine thereby to reduce exhaust pollution.

Another object of this invention is to supplement the fuel supply system of conventional internal combustion engines with a cooled, fuel-air vapor for introduction into the combustion chamber prior to each fuel-air charge from the carburetor.

A further object of this invention is to improve the operation, efficiency and longevity of internal combustion engines.

The present invention is summarized as anti-pollution apparatus for use in increasing the combustion efficiency of an internal combustion engine having a carburetor, a supply of fuel feeding the carburetor, and at least one combustion chamber receiving a fuel-air mixture from the carburetor, the apparatus including a first assembly adapted to be connected with the fuel supply for producing a fuel-air vapor at a temperature below ambient, and a second assembly coupled with the first assembly for supplying the vapor to the combustion chamber downstream of the carburetor, whereby the cooled vapor may be drawn into the combustion chamber prior to each fuel-air charge from the carburetor.

The present invention is further summarized as a method for increasing the combustion efficiency of an internal combustion engine, including the steps of producing a fuel-air vapor at a temperature below ambient, and supplying the vapor to an internal combustion engine downstream of the carburetor, whereby the cooled vapor may be drawn into the combustion chamber prior to each fuel-air charge from the carburetor.

The present invention is advantageous over the prior art in that engine efficiency is improved, the presence of unburned hydrocarbons and other pollutants is reduced, and the overall operation of the entire engine system is enhanced, all at a reasonable cost with minimal maintenance.

Other objects and advantages of the present invention will become apparent from the following description of a preferred embodiment when taken in conjunction with the accompanying drawings.

BRIEF DESCRIPTION OF THE DRAWINGS

FIG. 4 is a sectional view, in detail, of the air restrictor cartridge and fuel line termination of the evaporating coil of FIGS. 2 and 3; and FIG. 5 is a partial elevational view, in detail, of the fuel inlet and vapor outlet end of the evaporating coil of FIGS. 2 and 3.

DESCRIPTION OF THE PREFERRED EMBODIMENT

Figure 1:
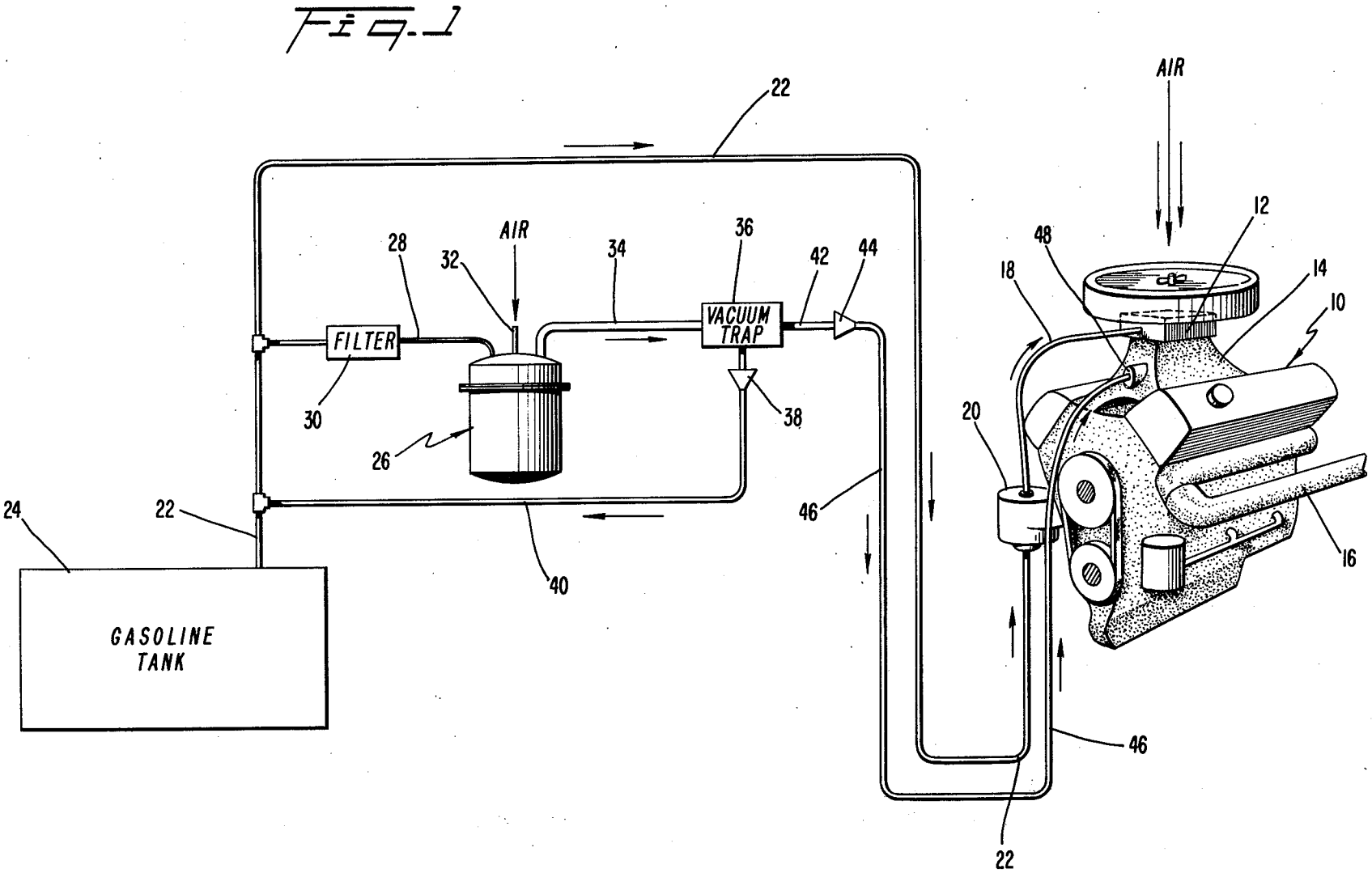
FIG. 1 is a diagrammatic view of an internal combustion engine equipped with a preferred embodiment of anti-pollution apparatus according to the present invention.

The present invention is designed for use as a supplement to an existing internal combustion engine or as part of a new internal combustion engine. As shown in FIG. 1, the invention may be used with an automobile engine 10 having a carburetor 12 mounted atop an intake manifold 14, and further having an exhaust manifold 16. The carburetor 12 receives liquid fuel, such as gasoline, from a fuel line 18 which is connected to the outlet of a fuel pump 20. The fuel pump is supplied with gasoline via fuel line 22 from the vehicle gasoline tank 24. All of the foregoing are conventional and can be used with no modification in conjunction with the anti-pollution apparatus and method according to the present invention.

The anti-pollution apparatus of the present invention includes an evaporating chamber 26 which is supplied with fuel from a fuel line 28 connected through a gasoline filter 30 to the main system fuel line 22. Filter 30 may be of any suitable type and prevents foreign particles and other materials which might be drawn from the gasoline tank 24 from entering the evaporating chamber 26. The evaporating chamber 26 has an air inlet tube 32 and supplies a cooled fuel-air vapor to an outlet vapor line 34.

Vapor line 34 is connected to the inlet of a vacuum trap 36 which is designed to separate vapor and liquid components. The liquid components are directed through a one-way valve 38 to a return fuel line 40 connected back through line 22 to the gasoline tank. The vapor outlet of vacuum trap 36 is connected through line 42 to another one-way valve 44. The outlet of this valve, in turn, supplies the cooled vapor through line 46 to a suitable fitting 48 in the engine intake manifold 14. Fitting 48 can be placed in any suitable position downstream of carburetor 12 so that the cooled vapor in line 46 is available to each combustion cylinder as a "pre-charge".

Figure 2:
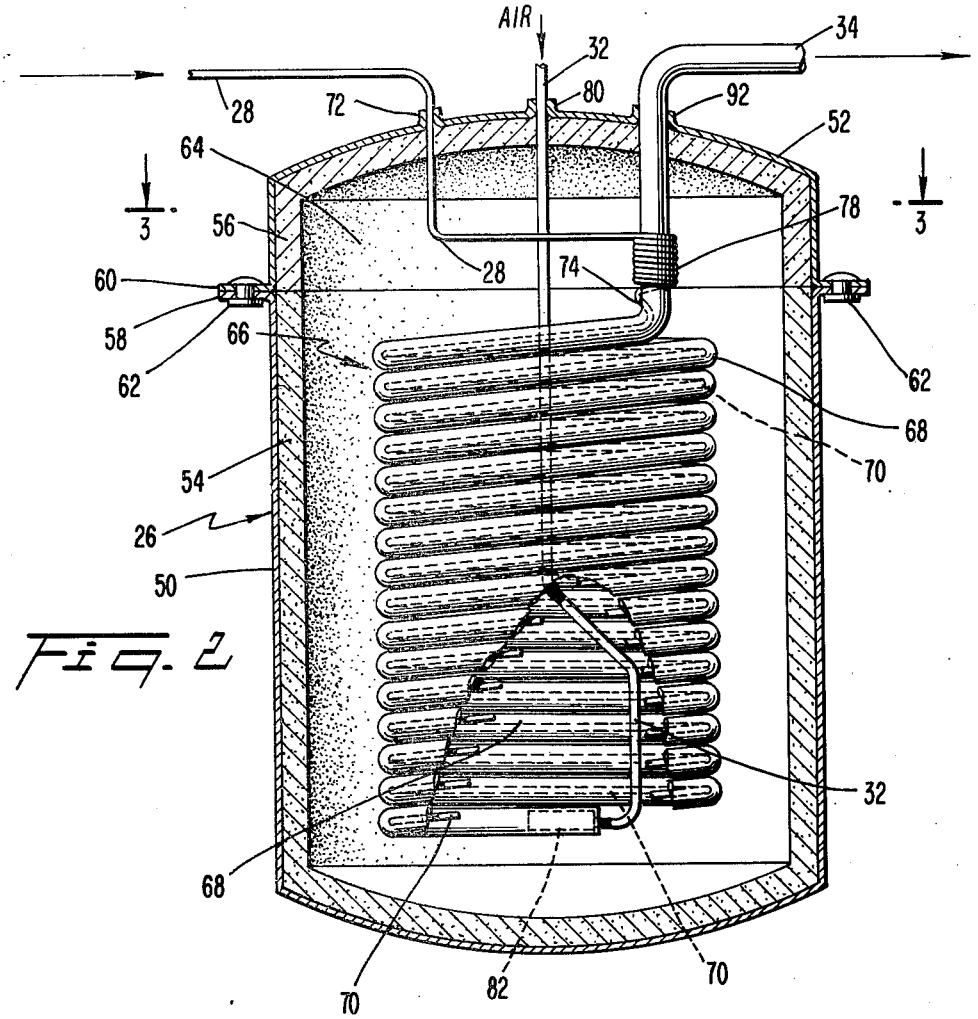
FIG. 2 is a cross-sectional view of the evaporating chamber of the anti-pollution apparatus of FIG. 1.
Figure 3:
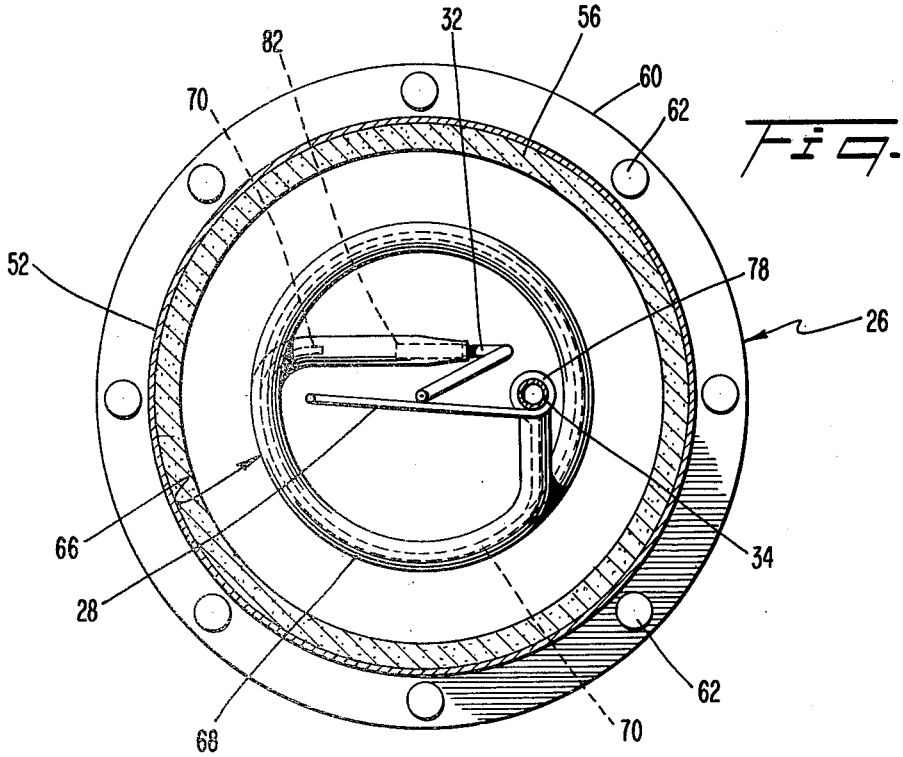
FIG. 3 is a sectional view taken along line 3—3 of FIG. 2.

Referring to FIGS. 2 and 3, the evaporating chamber according to the present invention includes a main housing 50 and a mating cover 52. Both the main housing 50 and cover 52 are provided with a suitable layer of thermal insulation 54 and 56, respectively, and are connected together by any suitable attachment such as cooperating flanges 58 and 60 and fasteners 62. While the overall shape of the main housing and lid, 50 and 52, may be cylindrical, as illustrated in FIGS. 1–3, it should be understood that any other shape may be used, together with any appropriate lid and fastening assembly, so long as there is provided a sealed, enclosed, thermally-insulated chamber 64 for receiving the evaporator coil assembly 66 according to the present invention.

Evaporator coil assembly 66 includes outer and inner coaxially disposed tubes 68 and 70, respectively, which are spiral wound to form a coil, as best shown in FIG. 2. The specific dimensions of the coil are not critical; however, exceptionally good results are achieved when the coil diameter is approximately 3½ inches and the coil contains from 3–16 turns. In the best mode, the coil contains 16 turns with the inner tube 70 formed of 0.029 inch diameter copper tubing and the outer coil formed of copper tubing having a diameter greater than ¼ inch. Since the object of the coil is to cool the exiting vapor, the temperature of the vapor can be reduced either by adding additional turns or by increasing the diameter of the coil.

Referring to FIGS. 2 and 5, the fuel inlet tube 28 is passed through a suitable hole 72 in the chamber wall and is wound about the outer tube 68 between 13 to 16 turns. The fuel inlet tube then passes through a small hole 74 in the wall of the outer tube 68 and continues in a generally coaxial position within the outer tube. Hole 74 is sealed by any suitable means such as adhesives, sealing compounds, or solder 76 to provide a fluid tight closure about the tube 70. The resulting coil 78 formed by the fuel tube acts as a precooling area for entering fuel and also functions to restrict or impede free fuel flow so as to enhance the evaporation of fuel in the other end of the main evaporator coil.

Referring to FIGS. 2 and 4, air tube 32, which passes through a suitable opening 80 in the chamber housing, is connected to a generally cylindrical, closed air restrictor cartridge 82. Air tube 32 and cartridge 82 are coupled by a suitable fluid tight seal, such as solder 84, and a plurality of holes 86 is provided in the cylindrical wall of the cartridge 82. Preferably, four holes are provided with increasing diameter going from the proximal end to the distal end of the cartridge 82, as shown in FIG. 4. The entire cartridge 82 is disposed within the lower end of outer tube 68, and the tube 68 is sealed by any suitable means, such as crimping and soldering, to form a fluid tight seal 88. It should be appreciated that the air restrictor cartridge 82 may be constructed of any suitable shape, and may be only partially disposed within the end of tube 68 depending upon the ultimate end seal technique which may be adopted. Other sealing and mounting arrangements may also be utilized without departing from the scope of the present invention, provided that the air ports or openings 86 function so as to produce a fuel-air mixture of approximately thirteen parts air to one part fuel. The inner fuel tube 70 preferably terminates at a point spaced from the distal end of cartridge 82 so as to leave an intermediate gap 90 at which fuel and air are initially mixed together. It has been experimentally found that a distance of approximately four inches between the distal end of cartridge 82 and the terminal end of tube 70 produces excellent results.

Outer tube 68 passes through the chamber housing through a suitable opening 92 to complete the assembly. It is noted that while fuel tube 28, air tube 32, and vapor outlet tube 34 are all illustrated as passing through openings in the chamber lid 52, such tubes could equally well pass through the main housing 50, if so desired. It is also not necessary for air tube 32 to pass through the center of the coil, and the tube 32 could directly exit the housing, adjacent the bottom end of the evaporator coil, without affecting system operation. It is also noted that while adjacent turns of the outer tube 68 are shown slightly spaced apart from each other in FIG. 2, it is preferred that they be in immediate contact so as to optimize the cooling effects produced during evaporation.

Before discussing the operation of the apparatus and method according to the present invention, a brief description of the operation of the conventional internal combustion engine will be helpful. It has been found that incomplete burning of the fuel in the combustion process is due to many factors. A predominant factor relates to the inherent action of the carburetor. In the carburetor, liquid fuel and air are combined to form a fuel-air mixture. When the fuel-air mixture flows down the throat of the carburetor, it is in an atomized form containing many tiny droplets. When the mixture of fuel and air reaches the intake manifold, under vacuum, the mixture rapidly expands. This rapid expansion causes the mixture to drop its temperature to below zero Fahrenheit. Approximately 80% of the atomized mixture reverts to a liquid, the remaining 20% remaining as a vapor. This wet and dry mixture travels to the combustion cylinders in an uneven form. Some cylinders will have a lean mixture and others will have a rich mixture. When ignition occurs, those cylinders which have improper mixtures will be only partially burned. The unburned fuel enters the exhaust manifold from which it is pumped out as unburned hydrocarbons, carbon monoxide, and oxides of nitrogen.

The present invention solves the above problem and improves operating efficiency by pre-expanding a portion of the fuel mixture in the evaporating chamber 26. This pre-expanded, cooled fuel-air vapor is then introduced into the intake manifold 14 through the vacuum trap 36. Since the outlet tube 34 of the chamber 26 is connected to the intake manifold 14, a partial vacuum exists within tube 34 to draw the fuel and air from tubes 28 and 32, respectively, through the evaporating chamber 26. As this occurs, fuel and air are mixed in the approximate ratio of thirteen parts air to one part fuel, and the fuel rapidly expands while it is still within the evaporator coil. As a result of this expansion, and the configuration of the evaporator coil, the fuel-air vapor exiting via outlet tube 34 is at a temperature of approximately minus ten degrees Fahrenheit. The sub-zero temperatures produced by rapid expansion in the coil function to separate the vapor (active portion) from the heavier liquid (inactive portion) by withdrawing the heat content of the fuel. Due to the fact that the vapor being generated by the coil flows into the intake manifold downstream of the carburetor, the active, pre-expanded and cooled, fuel-air vapor functions as a "pre-charge" to the conventional fuel-air charge from the carburetor 12. The cold fuel-air vapor lays a blanket of readily combustible material directly against the spark plugs. Upon ignition, the fuel-air vapor rapidly ignites and consumes the leaner mixture from the carburetor with increased efficiency. By maintaining a constant temperature of approximately ten degrees below zero Fahrenheit, the fuel-air vapor entering the intake manifold also tends to decrease manifold temperatures.

Referring to FIG. 1, when the internal combustion engine is operating, a vacuum exists in line 46 which draws the fuel-air vapor from vacuum trap 36. The liquid components are separated in the vacuum trap and are returned to the fuel supply tank via line 40. The vacuum in the vacuum trap in turn draws on line 34 to draw liquid fuel or gasoline from the gasoline tank 24 through filter 30. Within the evaporating chamber 26, thirteen parts of air are mixed with one part of liquid gasoline in the coaxial coil. When the fuel merges with the air, it rapidly expands, changing phase from liquid to vapor. This change of phase requires heat which is absorbed from the outer tube within which the smaller fuel tube is disposed. Consequently, the temperature within the coil rapidly drops to below zero Fahrenheit which acts upon the molecules of liquid fuel causing them to move closer together. The heat which was absorbed from the outer tube changes a part of the fuel-air mixture to gasoline vapor. This vapor flows through outlet tube 34 to the vacuum trap 36. In vacuum trap 36, liquid is trapped and directed through one-way valve 38 to the return line 40 while the vapor is allowed to pass through line 42 and valve 44 to the intake manifold. In this manner, a cooled, fuel-air vapor is supplied to the engine downstream of the carburetor so as to promote increased operating efficiency and reduce the generation of environmental pollutants.

It can be appreciated from the foregoing that the present invention can be used as part of any number of different types of internal combustion engines as a complete, efficient system. In addition, the invention can be embodied in apparatus for convenient attachment to existing internal combustion engines whereupon engine efficiency will be improved, and pollution reduced, with minimal cost. The apparatus and efficiency increasing method according to the present invention result in significant advantages including the development of greater power, reduced spark plug wear, smoother and cooler engine operation, reduced wear and corrosion of muffler and exhaust parts, reduced breakdown and contamination of lubricating oil, and the removal of carbon deposits for the promotion of cleaner engine operation. Most importantly, testing of experimental units has shown that existing internal combustion automobile engines, when equipped with apparatus according to the present invention, show a substantial reduction in pollution output to levels far below even the most stringent regulations presently in existence. In fact, in several experimental tests, almost negligible pollutants were measured in the exhaust emissions.

Inasmuch as the present invention is subject to many variations, modifications and changes in detail, it is intended that all matter contained in the foregoing description or shown in the accompanying drawings shall be interpreted as illustrative and not in a limiting sense.

What is claimed is:

1. In an internal combustion engine having a carburetor, a supply of fuel feeding the carburetor, at least one combustion chamber receiving a fuel-air mixture from the carburetor, and anti-pollution apparatus for use in increasing the combustion efficiency of the engine, the improvement wherein said anti-pollution apparatus comprises:

first means connected with the fuel supply for producing a fuel-air vapor at a temperature below ambient; and second means coupled with said first means and connected to the engine downstream of the carburetor for supplying said vapor to the combustion chamber, whereby said cooled vapor may be drawn into the combustion chamber ahead of each fuel-air charge from the carburetor.

2. Anti-pollution apparatus as recited in claim 1 wherein said second means comprises first and second one-way valves, and a vacuum trap having an inlet connected to said first means, a vapor outlet connected to said first valve, and a liquid fuel outlet connected to said second valve; and wherein the outlet of said first valve is adapted to be connected to the internal combustion engine intake manifold, and the outlet of said second valve is adapted to be connected to the fuel supply.

3. Anti-pollution apparatus as recited in claim 1 wherein said first means comprises an evaporating chamber having a fuel inlet, an air inlet, a fuel-air vapor outlet, and means connected to said inlets and said outlet for mixing fuel and air in a predetermined proportion to form a fuel-air vapor and for cooling the fuel-air vapor in response to the application of a vacuum at said outlet.

4. Anti-pollution apparatus as recited in claim 3 wherein said mixing and cooling means mixes fuel and air in the approximate ratio of 1 part fuel to 13 parts air.

5. Anti-pollution apparatus as recited in claim 3 wherein said temperature is below zero degrees Fahrenheit.

6. Anti-pollution apparatus as recited in claim 3 wherein said mixing and cooling means comprises coaxially disposed inner and outer tubes spiral wound to form a coil, said inner tube being connected at one end of said coil to said fuel inlet, and said outer tube being connected at said one end of said coil to said fuel-air vapor outlet; and wherein said evaporating chamber further comprises an air supply tube connected between said air inlet and the other end of said coil.

7. Anti-pollution apparatus as recited in claim 6 wherein said evaporation chamber further comprises a thermally insulated housing; and wherein said coil is disposed in said housing.

8. Anti-pollution apparatus as recited in claim 6 wherein said coil is 3½ inches in diameter and has 3 to 16 turns.

9. Anti-pollution apparatus as recited in claim 6 wherein said inner tube passes out through a hole in the wall of said outer tube at said one end of said coil, said hole being sealed fluid-tight around said inner tube.

10. Anti-pollution apparatus as recited in claim 9 wherein the protruding end of said inner tube is spiral wound around said outer tube adjacent said hole.

11. Anti-pollution apparatus as recited in claim 10 wherein said protruding end of said inner tube is wound around said outer tube 13 to 16 turns.

12. Anti-pollution apparatus as recited in claim 6 wherein said air supply tube is connected by a fluid-tight connection to a generally cylindrical air restrictor cartridge which is closed with the exception of at least one air port in a cylindrical wall thereof, said cartridge being disposed within said outer tube at the other end thereof, and said outer tube being closed by a fluid-tight seal about said air tube at said other end.

13. Anti-pollution apparatus as recited in claim 12 wherein said inner tube at said other end of said coil terminates at a location spaced from the distal end of said cartridge to form a fuel-air mixing chamber.

14. Anti-pollution apparatus as recited in claim 12 wherein said air restrictor cartridge defines a plurality of holes in the cylindrical wall thereof.

15. Anti-pollution apparatus as recited in claim 14 wherein said holes in said cartridge are progressivey larger in size going from the proximal end to the distal end of said cartridge.

16. Anti-pollution apparatus as recited in claim 15 wherein said holes in said cartridge are axially aligned.

17. A method for increasing the combustion efficiency of an internal combustion engine having a carburetor, a supply of fuel feeding the carburetor, and at least one combustion chamber receiving a fuel-air mixture from the carburetor, the improvement comprising the steps of:

producing a fuel-air vapor at a temperature below ambient; and supplying said vapor to the combustion chamber downstream of the carburetor, whereby said cooled vapor may be drawn into the combustion chamber prior to each fuel-air charge from the carburetor.

18. A method as recited in claim 17 wherein said producing step comprises evaporating liquid fuel under a vacuum and mixing the evaporated fuel with air.

19. A method as recited in claim 18 wherein said producing step further comprises cooling said liquid fuel prior to evaporation.

20. A method as recited in claim 17 wherein said supplying step comprises feeding said fuel-air vapor through a vacuum trap to remove liquid fuel droplets, and applying the fuel-air vapor from said vacuum trap to the internal combustion engine intake manifold.

* * * * *